US007197840B2

(12) United States Patent
Nakano

(10) Patent No.: US 7,197,840 B2
(45) Date of Patent: Apr. 3, 2007

(54) FOOTWEAR AND RELATED METHOD OF MANUFACTURE

(75) Inventor: Kiyotaka Nakano, Rockford, MI (US)

(73) Assignee: Wolverine World Wide, Inc., Rockford, MI (US)

( * ) Notice: Subject to any disclaimer, the term of this patent is extended or adjusted under 35 U.S.C. 154(b) by 63 days.

(21) Appl. No.: 11/065,851

(22) Filed: Feb. 25, 2005

(65) Prior Publication Data

US 2006/0191163 A1 Aug. 31, 2006

(51) Int. Cl.
*A43B 9/02* (2006.01)

(52) U.S. Cl. ..... 36/19 R; 36/30 R; 12/142 B

(58) Field of Classification Search ..... 36/103, 36/16, 19 R, 30 R, 102; 12/142 B, 142 C, 12/142 T See application file for complete search history.

(56) References Cited

U.S. PATENT DOCUMENTS

| | | | | |
|---|---|---|---|---|
| 392,677 | A | 11/1888 | King | |
| 1,602,675 | A | 10/1926 | Hurley | |
| 1,709,735 | A | 4/1929 | Parlante | |
| 2,005,048 | A | 6/1935 | Randall | |
| 2,038,528 | A | 4/1936 | McCarthy | |
| 4,869,001 | A | 9/1989 | Brown | |
| 4,918,776 | A | 4/1990 | Motoda | |
| 5,174,049 | A * | 12/1992 | Flemming | 36/28 |
| 5,546,680 | A | 8/1996 | Barma et al. | |
| 5,729,918 | A | 3/1998 | Smets | |
| 5,933,896 | A | 8/1999 | Gallina | |
| 6,055,745 | A * | 5/2000 | Endoh | 36/12 |
| 6,484,420 | B1 | 11/2002 | Chi et al. | |
| 6,757,990 | B2 | 7/2004 | Chi et al. | |
| 2004/0172849 | A1 | 9/2004 | Issler | |
| 2004/0187348 | A1 | 9/2004 | Chi et al. | |
| 2004/0205980 | A1 * | 10/2004 | Issler | 36/19 R |
| 2005/0022425 | A1 * | 2/2005 | Brown | 36/30 R |

FOREIGN PATENT DOCUMENTS

| | | |
|---|---|---|
| DE | 29 00 089 A1 | 1/1979 |
| DE | 30 43 725 A1 | 11/1980 |
| EP | 0041036 A1 | 5/1981 |
| EP | 0988806 A1 | 9/1999 |
| EP | 1352578 A1 | 3/2003 |
| EP | 1454549 A1 | 3/2004 |
| GB | 808333 | 7/1956 |
| GB | 1153867 | 11/1965 |
| GB | 1531230 | 12/1974 |

* cited by examiner

*Primary Examiner*—Ted Kavanaugh
(74) *Attorney, Agent, or Firm*—Warner Norcross & Judd LLP

(57) ABSTRACT

A footwear construction including a midsole having medial and lateral flanges, and that defines a recess in the heel. An upper can be joined to the flanges along a lower peripheral allowance of the upper. The flanges can be separated into a medial forefoot flange segment and a medial heel flange segment, and a lateral forefoot flange segment and a lateral heel flange segment, respectively. The footwear optionally can include an outsole and an optional heel wedge, either or both of which can define a secondary recess into which the midsole interfits. A method for constructing the footwear includes providing the midsole, joining an upper peripheral allowance with the flanges, and joining an outsole with the midsole. Optionally, a heel wedge can be secured between the midsole and the outsole.

20 Claims, 4 Drawing Sheets

FOOTWEAR AND RELATED METHOD OF MANUFACTURE

BACKGROUND OF THE INVENTION

The present invention relates to footwear and, more particularly, to a footwear construction and method for making the same.

There is an ongoing effort in the footwear industry to produce footwear that provides flexibility and stability. Such footwear is targeted toward individuals whose lifestyle and/or profession demand high levels of physical activity, for example, traveling on foot for significant distances, or frequently traversing rugged terrain or worksites.

Conventional footwear constructions, however, provide one of flexibility and stability, but usually not both because the features required for these characteristics typically negate one another. For example, one construction known for its flexibility is a San Crispino construction, which may be incorporated into tactical, military, work or hiking boots. In such a construction, an upper is sewn to a flat, foot shaped insole board. Specifically, a first part of a lower edge of the upper is stitched to a top surface of the insole board. A remaining part of the edge is wrapped over the periphery of the insole-board, and folded back under the board, against the bottom surface of the board. A flat outsole is glued over the bottom surface of the insole board and any part of the upper that is folded against the bottom side of the insole board.

Although this construction is flexible and aesthetically pleasing, it frequently compromises the stability of the footwear, especially in the heel and ankle region. Moreover, because the insole and outsole are of a substantially uniform thickness from heel to toe of the footwear, there is little or no cushion variation provided for different regions of the foot, which in turn, can compromise the comfort of the shoe.

Although different constructions exist that provide desired characteristics such as flexibility, there remains an unmet need for a footwear construction that provides the best of both flexibility and stability.

SUMMARY OF THE INVENTION

The aforementioned problems are overcome by the present footwear construction including a midsole that has medial and lateral flanges, and that defines a recess in the heel. An upper can be stitched to the medial and lateral flanges along a lower periphery of the upper.

In a more specific embodiment, the part of the midsole defining the recess can nest in a heel wedge. An outsole can be secured to the heel wedge generally in the heel region and to the midsole generally in the forefoot region.

In an even more specific embodiment, medial and lateral flanges can be segmented into separate or non-contiguous heel and forefoot flange segments. The heel wedge can include a concealment flange disposed adjacent the upper in the area between the heel and forefoot flange segments.

In an even more specific embodiment, a foot bed interfits over the midsole, and nests at least partially within the heel recess. Optionally, the midsole can be constructed from a dual density material, with a softer density material being located in the forefoot region, generally below the ball of a wearer's foot.

The footwear construction is manufactured by: providing an upper and including a peripheral allowance; joining the peripheral allowance with a midsole including a medial forefoot flange segment and a medial heel flange segment, and a lateral forefoot flange segment and a lateral heel flange segment, the midsole including a heel region and defining a heel recess in the heel region; and joining an outsole with the midsole. Optionally, a heel wedge can be positioned between the midsole and outsole in the heel region. Further optionally, a foot bed can be positioned over the midsole and at least partially in the heel recess.

The present footwear construction provides an unparalleled combination of flexibility and stability. In the forefoot region, the medial and lateral midsole flanges stitched to the upper makes this region flexible, yet well-supported. In the heel region of the footwear, the midsole heel recess provides extraordinary stability for the ankle and heel of a wearer. Further coupled with an optional heel wedge, the footwear becomes even more stable, but still capable of absorbing heel shock.

These and other objects, advantages and features of the invention will be more readily understood and appreciated by reference to the detailed description of the invention and the drawings.

DETAILED DESCRIPTION OF THE INVENTION

I. Overview

Figure 1:
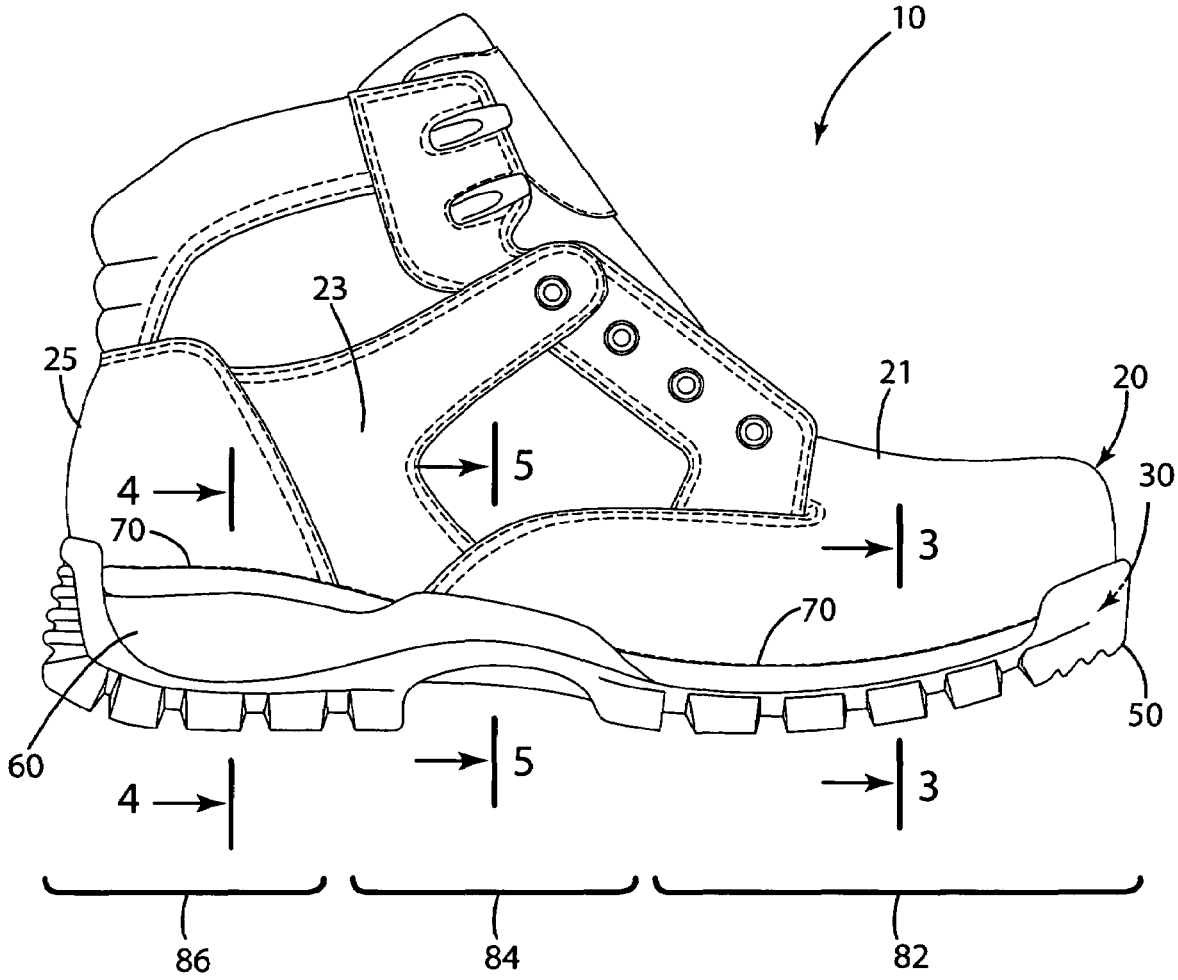
FIG. 1 is side elevational view of an article of the present footwear construction.

A shoe incorporating an embodiment of the footwear construction is shown in FIG. 1 and generally designated 10. For purposes of the disclosure, the construction is described in connection with a ¾ height tactical boot; however, the construction is well suited for use with any other type of soled footwear.

In general, the shoe 10 includes an upper 20, a midsole 30 and an outsole 50. An optional heel wedge 60 can be included, but is not required. The midsole, shown better in FIG. 2, includes a medial flange 32 and a lateral flange 36, which optionally can be subdivided into a medial forefoot flange segment 33 and a medial heel flange segment 35, and a lateral forefoot flange segment 37 and a lateral heel flange segment 39, respectively. The midsole can also define a heel recess 34. The upper can include a lower peripheral allowance 22, which can be secured to at least one of the flange segments noted above.

As used herein, the term "arch region" refers generally to the portion of the shoe corresponding to the arch of the wearer's foot; the term "forefoot region" refers generally to the portion of the shoe forward of the arch region corresponding to the forefoot (e.g., the ball, phalanges, and toes) of a wearer's foot; and the term "heel region" refers generally to that portion of the shoe rearward of the arch region corresponding to the heel of the wearer's foot. The forefoot region 82, arch region 84 and heel region 86 are generally identified in FIG. 1, however, it is to be understood that delineation of these regions may vary depending upon the configuration of the footwear.

II. Construction

Figure 2:
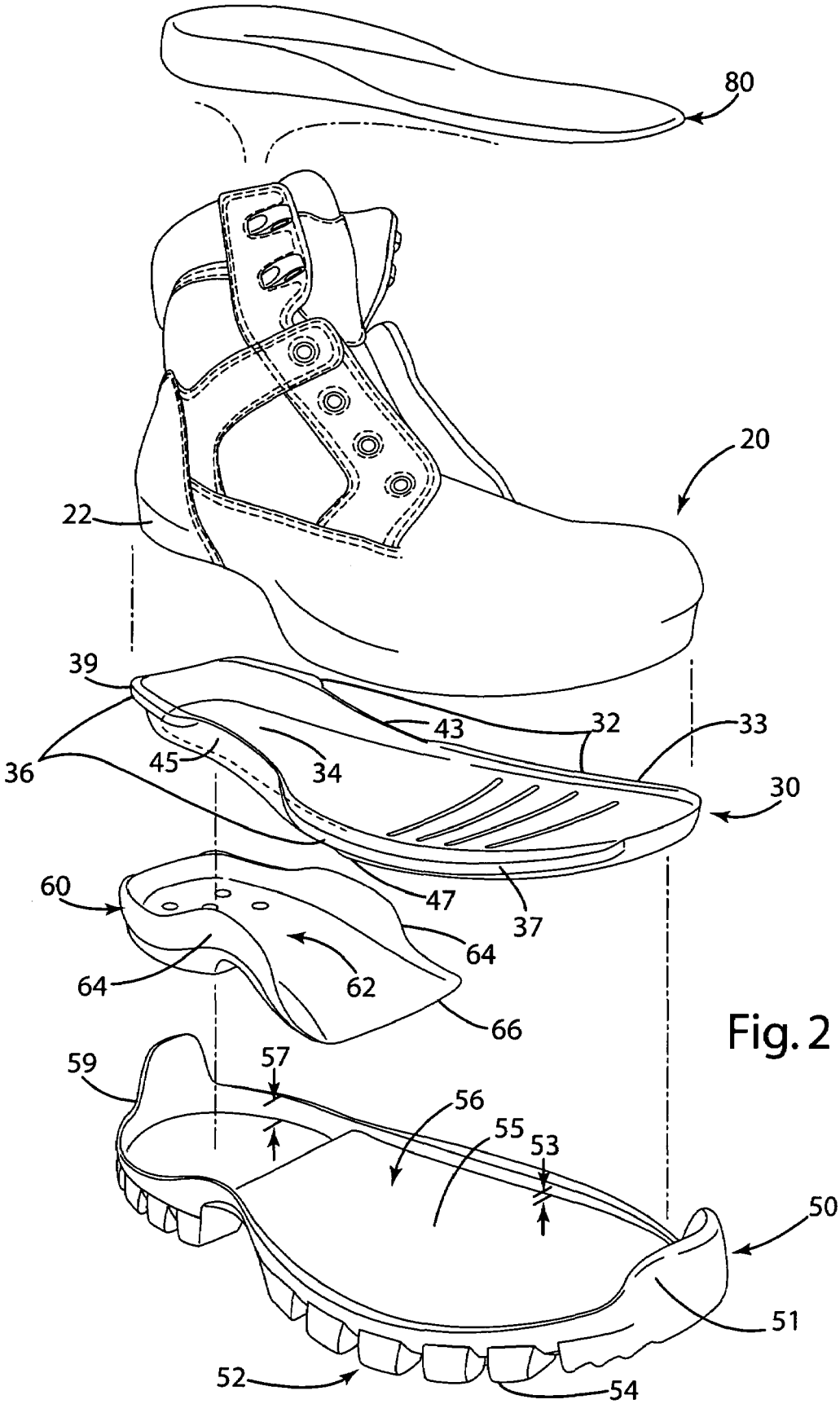
FIG. 2 is an exploded perspective view of the footwear.

The components of the construction 10 will now be described. To begin, the upper 20 is generally conventional and will not be described in detail. Suffice it to say that the upper 20 includes vamp 21, quarters 23 and backstay 25. With reference to FIG. 2, the upper 20 includes a lower portion that transitions to an allowance 22, also referred to as a peripheral allowance. The peripheral allowance 22 is joined with the midsole 30 as described in more detail below. Such joining may be accomplished by stitching, stapling, cementing, riveting, or any other type of fastening. The upper 20 can be manufactured from leather, canvas, nylon, combinations of these materials, or other suitable materials, and can include a liner, waterproof or otherwise, (not shown) or other conventional accessories.

The midsole includes a medial flange 32 and a lateral flange 36. The medial flange 32 can be segmented into a medial forefoot flange segment 33 and a medial heel flange segment 35. The medial forefoot flange segment 33 and a medial heel flange segment 35 can be non-contiguous with one another or separated from one another by a distance. In the embodiment shown, a first recess 43 separates the segments. The lateral flange 36 can be segmented into a lateral forefoot flange segment 37 and a lateral heel flange segment 39. The lateral forefoot flange segment 37 and a lateral heel flange segment 39 can also be non-contiguous with one another or separated from one another by a distance. In the embodiment shown, a second recess 45 separates these segments. Although not shown, the lateral and medial segments can traverse the heel and/or toe of the footwear and connect with one another as desired. In such an embodiment, the toe 51 and heel 59 guards can be eliminated and/or shortened.

As shown in FIG. 2, the midsole 30 can define a heel recess 34. This heel recess 34 can be defined in the heel region of the footwear and extend forward to the arch region, and in some cases, the forefoot region as desired. The heel recess 34 can be configured to fit at least partially in the heel wedge recess 62, described below, and to receive at least the foot bed, described below.

The midsole 30 can optionally include a ridge 47 on its bottom surface that cooperates with a forward portion 66 of the heel wedge 60 to position the midsole 30 over the outsole 50 and/or heel wedge 60.

The midsole 30 can be constructed from one or more materials, each of a different density. For example, the flanges 32 and 36 can be constructed from a relatively hard ethyl vinyl acetate (EVA) or rubber, while the portion 31 of the midsole corresponding to the center of the wearer's foot along the axis of the foot, and/or corresponding to the ball of the wearer's foot, can be constructed from a softer EVA or softer rubber to provide improved flexibility and/or cushion in this area. Optionally, certain components, such as the flanges can be constructed from a completely different material, such as polyurethane, where it is expected that those components will undergo additional structural stresses, for example, where the flanges 32, 36 are stitched in a region of moderate to high flex.

Figure 3:
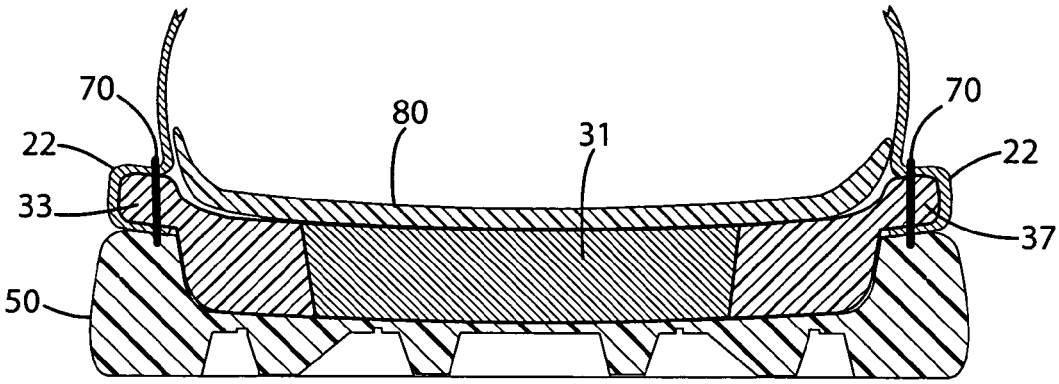
FIG. 3 is a sectional view of the footwear taken along line 3—3 of FIG. 1.
Figure 4:
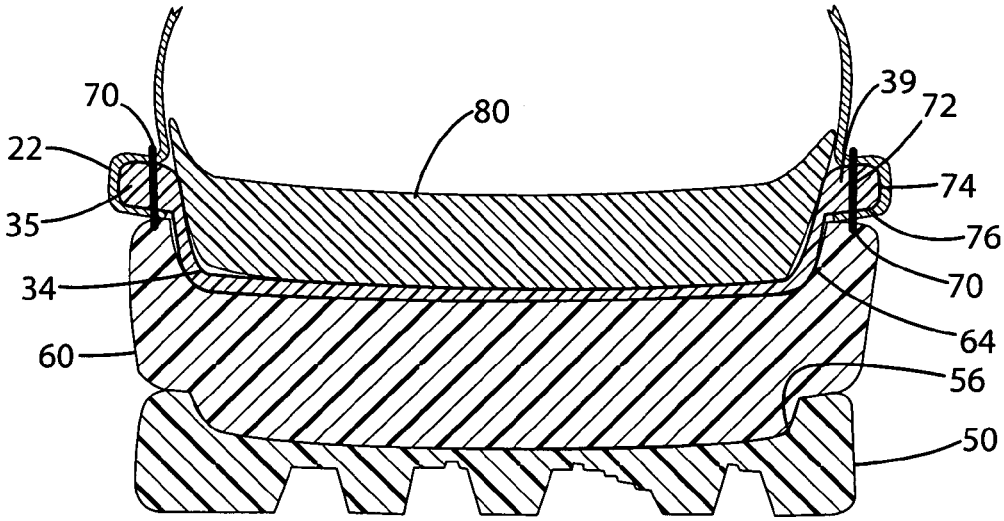
FIG. 4 is a sectional view of the footwear taken along line 4—4 of FIG. 1.
Figure 5:
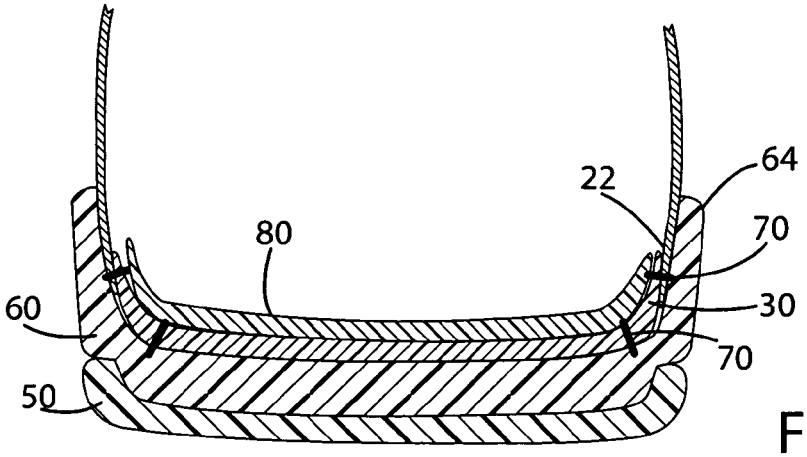
FIG. 5 is a sectional view of the footwear taken along line 5—5 of FIG. 1.

The upper 20 can be joined with the midsole 30. In the embodiment shown, the peripheral allowance 22 can be stitched to the segments 33, 35, 37 and 39. Specifically, as shown in FIGS. 3–5, the lower peripheral allowance 22 can be wrapped over the upper surface 72 of the segments, around the edge 74 of the segments, and folded back under against the lower surface 76 of the segment and/or midsole. Stitching 70 can pass through the lower peripheral allowance, the upper surface, the lower surface and then in reverse direction multiple times to secure the allowance to the respective segment. This stitching can remain visible, as shown in FIG. 1 to enhance the aesthetics of the footwear as desired.

In the regions between the segments, for example, in the recesses 43, 45, and/or in the arch region (FIG. 5), the allowance 22 can be stitched directly to the midsole 30, i.e., not the segments, to further secure the upper and midsole. The stitching 70 in this region can pass through the midsole 30 and allowance 22, and then back through the midsole 30, multiple times to secure the upper to the midsole. The stitching 70 can then transition to pass through the segments on opposite sides of the recesses 43, 45. In the arch region 74, the stitching 70 can be concealed as desired, for example by the flange 64, as described below.

The upper 20 and midsole 30 can be joined with other fastening mechanisms, such as cement, rivets, staples and the like as desired.

An optional footbed 80 can be inserted in the interior of the footwear 10 and placed above the midsole 30. The footbed 80 can rest at least partially in the heel recess 34 in the heel and/or arch regions as desired. The footbed 80 can rest above the midsole 30 in the forefoot region.

The footwear 10 can include an optional heel wedge 60. The heel wedge shown in FIGS. 2–5 is a separate component adapted to fit between the midsole 30 and the outsole 50, generally in at least the heel region 86 of the footwear. However, the heel wedge can also be constructed to be an integral part of the outsole as the application requires. The heel wedge 60 can be constructed of a cushioning material, such as EVA, to improve cushioning in the heel and/or arch regions of the footwear. The heel wedge 60 can alternatively be constructed from a denser material, such as polyurethane to add stability to regions of the footwear as desired; As shown, the heel wedge 60 includes a secondary recess, also referred to as a heel wedge recess 62. This heel wedge recess 62 can be configured to receive therein the midsole 30 in the heel 76 and/or arch 74 regions.

As shown in FIGS. 1 and 2, the recess 62 is configured so that at least a portion of the midsole 30 defining the heel recess 34 fits in the recess 62. Optionally, the secondary recess 62 can be of a depth such that midsole 30 in the heel region nests within the recess 62 so that the medial heel flange segment 35 and lateral heel flange segment 39 protrude over the sides of the recess to provide an aesthetically pleasing and flush contour with the remainder of the heel wedge 60 that is visible.

The heel wedge 60 can also include at least one upwardly extending flange 64. This flange 64 can extend upward on both the medial and lateral sides of the footwear 10 as the application requires. As shown in FIG. 2, flanges 64 can extend upward between the medial forefoot flange segment 33 and a medial heel flange segment 35, as well as between the lateral forefoot flange segment 37 and a lateral heel flange segment 39. Where these segments form recesses 43, 45 therebetween, the flanges 64 can be disposed within those recesses on opposite sides of the footwear, respectively. The flanges 64 can also be of a height such that they extend above the flanges 32, 36, and are secured to a portion of the upper 20 in these areas. Optionally, the flanges can be of sufficient rigidity so that they form an external shank to add stability to the footwear in the heel and/or arch regions of the footwear 10. Alternatively, the outsole 50 can include upwardly extending flanges (not shown) that are positioned and operate similarly to the flanges 64 of the heel wedge described above.

Further optionally, the heel wedge 60 can include an internal shank (not shown) constructed of steel plastic or other material to add the desired structural rigidity to the footwear as desired. Optionally, the shank can be simply secured to the bottom of the heel wedge in the arch region 74 of the shoe. The shank can be secured to other components of the shoe as desired, and may overlap with the other regions, for example, the forefoot 72 region and heel 76 region.

The outsole 50 is manufactured from a relatively hard rubber or other sufficiently durable and wear-resistant material. The bottom 52 can include an outer surface 54 that forms the wearing surface of the outsole 50, and can be contoured to the desired heel and tread pattern.

The outer surface 54 can be textured to improve the traction and aesthetic appeal of the shoe. Optionally, the upper surface 55 of the outsole may be textured as desired to improve adhesion thereto.

As shown in FIGS. 1 and 2, the outsole 50 can include an outsole recess 56 defined generally from heel to toe of the outsole. This recess can be of a first depth 53 in the forefoot and transition to a second depth 57 in the heel. The first depth 53 can be such that the midsole 30 nests within the recess 56 to a depth where the medial 33 and lateral 37 forefoot segments, covered with the peripheral allowance 22, rest flush atop the walls of the recess to provide a clean, finished appearance. The second depth 57 in the heel region can be such that the heel cradle at least partially nests within the recess 56.

The outsole as shown in FIGS. 1 and 2 can further optionally include toe 51 and heel 59 guards. These guards can be configured to wrap upward and be secured to the toe and heel portions of the upper 20 as desired. In one embodiment, the toe guard 51 can be configured to abut against the forward portions of the medial 33 and lateral 37 forefoot segments to provide a clean, finished look. Likewise, the heel guard can be configured to abut against the rearward portions of the medial 35 and lateral 39 heel segments.

III. Manufacture and Assembly

Manufacture of the footwear 10 will now be described with reference to FIGS. 1–5. The upper 20 is manufactured using generally conventional techniques and apparatus. The desired upper material (not shown) is cut to form the upper and its components. The multiple upper components, such as the vamp 21, quarters 23 and backstay 25, are fitted and sewn together. An optional liner (not shown) is secured within the upper 20 via adhesives or stitching.

Figure 6:
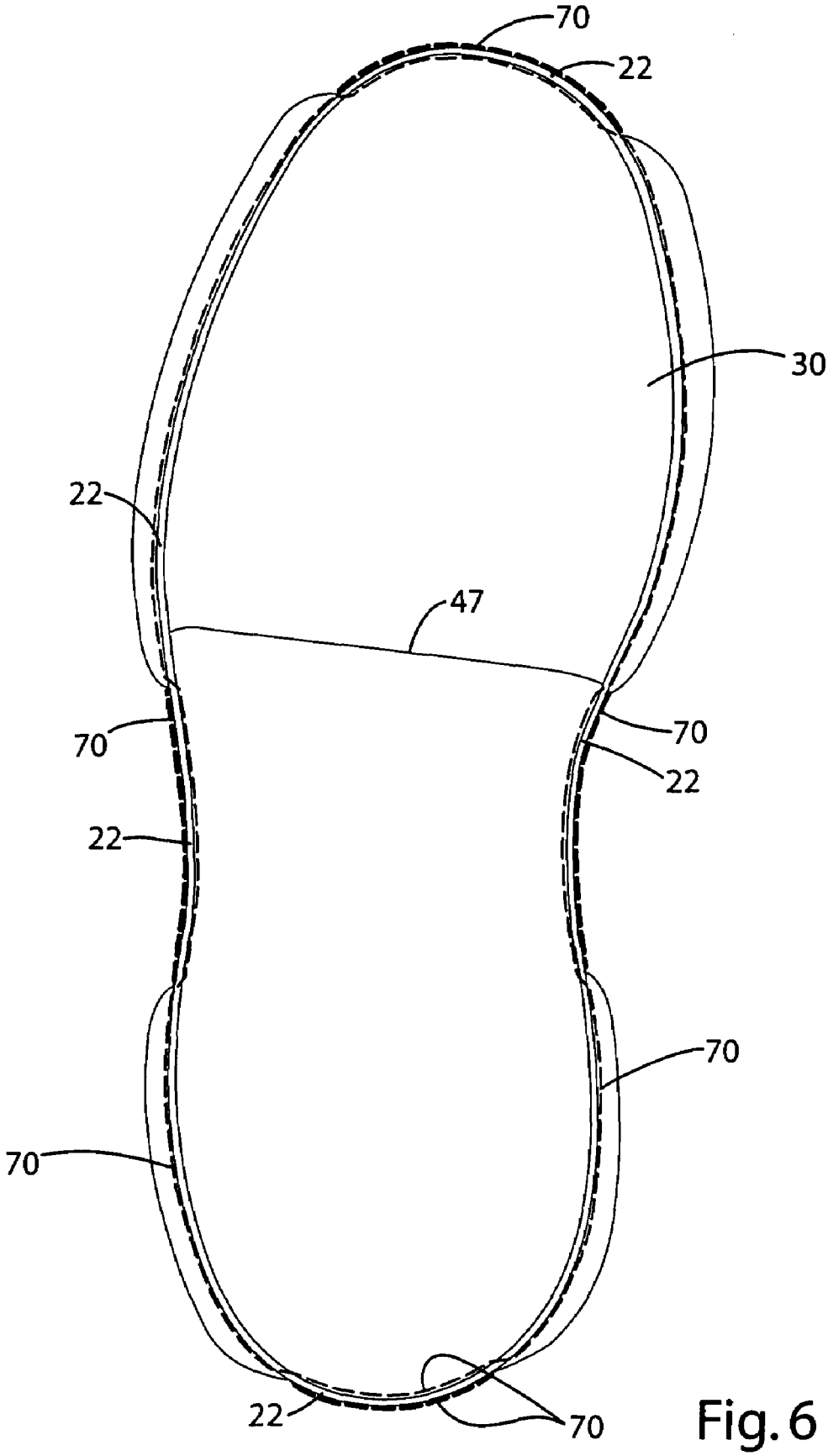
FIG. 6 is a bottom perspective view of the footwear showing the upper joined with the midsole.

The midsole 30 described above is manufactured using conventional molding apparatus modified to accommodate the features of the present midsole. The allowance 22 of the upper is stitched using a San Crispino stitching method to the segments 33, 35, 37 and 39. Specifically, as shown in FIGS. 3–5, the lower peripheral allowance 22 is wrapped over the upper surface 72 of the segments, around the edge 74 of the segments, and folded back under against the lower surface 76 of the segment and/or midsole. Stitching 70 passes through the lower peripheral allowance, the upper surface, the lower surface and then in reverse direction multiple times to secure the allowance to the respective segment. In the regions between the segments, e.g., in the recesses 43, 45, the allowance 22 is stitched to the midsole 30 to further secure the upper and midsole. In the optional embodiment shown in FIG. 6, the stitching 70 secures the allowance 22 to the midsole 30 in a 360 degree manner around the entire perimeter of the midsole and/or footwear.

The outsole 50 is injection molded or pour molded from a hard, durable rubber using conventional molding apparatus. Its construction can be completed before any other components of the footwear are assembled as desired. The tread pattern 58 on the lower surface 56 are formed during the molding operation as integral parts of the outsole 50. With the outsole manufactured, the heel wedge 60 is secured to the outsole 50. These components may be secured together with cement, adhesive or other attachment means.

In another step, the heel wedge 60 and outsole 50 combination is further cemented to the lower surface of the midsole 30. Where the flange 64 extends upward from the wedge 60 or outsole 50, that portion can be cemented to the upper as well. The toe and heel guards can further be cemented to the upper as desired as well.

With the upper 20, midsole 30, heel wedge 60 and outsole 50 assembled into the footwear 10, a footbed 80 can be inserted into the upper to rest in place above the midsole as described above.

A number of conventional finishing operations may then be performed on the shoe 10. For example, the edges of the heel cradle 60 and the outsole 40 are trimmed and shaped. The upper 20 is cleaned, polished and treated as appropriate and necessary.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The invention claimed is:

1. A footwear construction comprising:

an upper including a peripheral allowance;

a midsole including a medial flange extending upwardly and outwardly from a medial side of the midsole to form a medial flange upwardly projecting portion and a medial flange outwardly projecting portion, a lateral flange extending upwardly and outwardly from a lateral side of the midsole to form a lateral flange upwardly projecting portion and a lateral flange outwardly projecting portion, a forefoot region, an arch region and a heel region, the heel region defining a heel recess corresponding to the heel of a wearer, the medial flange and the lateral flange stitched to the peripheral allowance of the upper so that the peripheral allowance covers at least a portion of at least one of the medial flange outwardly projecting portion and the lateral flange outwardly projecting portion;

a footbed positioned over the midsole so that at least a portion of the footbed rests in the heel recess;

a heel wedge joined with the heel region of the midsole; and an outsole joined with the forefoot region of the midsole, the outsole further joined with the heel wedge.

2. The footwear construction of claim 1 wherein the medial flange includes a medial forefoot segment and a medial heel segment, and wherein the lateral flange includes a lateral forefoot segment and a lateral heel segment.

3. The footwear construction of claim 2 wherein the medial forefoot segment and the medial heel segment are separated by a first recess, and wherein the lateral forefoot segment and a lateral heel segment are separated by a second recess.

4. A footwear construction comprising:

an upper including a peripheral allowance;

a midsole including a medial flange extending from a medial side of the midsole, a lateral flange extending from a lateral side of the midsole, a forefoot region, an arch region and a heel region, the heel region defining a heel recess corresponding to the heel of a wearer, the medial flange and the lateral flange stitched to the peripheral allowance of the upper;

wherein the medial flange includes a medial forefoot segment and a medial heel segment, and wherein the lateral flange includes a lateral forefoot segment and a lateral heel segment;

wherein the medial forefoot segment and the medial heel segment are separated by a first recess, and wherein the lateral forefoot segment and a lateral heel segment are separated by a second recess;

a footbed positioned over the midsole so that at least a portion of the footbed rests in the heel recess;

a heel wedge joined with the heel region of the midsole;

an outsole joined with the forefoot region of the midsole, the outsole further joined with the heel wedge; and wherein at least one of the heel wedge and the outsole include a concealment flange that extends upwardly into at least one of the first recess and the second recess.

5. The footwear construction of claim 4 wherein at least one of the first recess and the second recess correspond to the arch region of the midsole.

6. The footwear construction of claim 5 wherein the peripheral allowance of the upper is stitched to the midsole in the arch region.

7. The footwear construction of claim 6 wherein the midsole is constructed from a dual density material, with a softer material being located in the forefoot region in a location corresponding to the ball of a wearer's foot.

8. A footwear construction comprising:

an upper defining an interior, and including an exterior and a peripheral allowance;

a midsole including a medial forefoot flange segment and a medial heel flange segment, and a lateral forefoot flange segment and a lateral heel flange segment, the midsole including a heel region and defining a heel recess in the heel region, the peripheral allowance being substantially wrapped over and concealing at least one of the medial heel flange segment, the medial forefoot flange segment, the lateral forefoot flange segment and the lateral heel flange segment; and an outsole joined with the midsole.

9. The footwear construction of claim 8 comprising a heel wedge positioned between the midsole and the outsole in the heel region.

10. The footwear construction of claim 8 wherein the medial forefoot segment and the medial heel segment are separated by a first recess, and wherein the lateral forefoot segment and a lateral heel segment are separated by a second recess.

11. The footwear construction of claim 8 wherein peripheral allowance is stitched to the medial heel flange segment, the medial forefoot flange segment, the lateral forefoot flange segment and the lateral heel flange segment.

12. The footwear construction of claim 8 comprising a foot bed having a heel part, the heel part nesting at least partially in the heel recess of the midsole.

13. A footwear construction comprising:

an upper defining an interior, and including an exterior and a peripheral allowance;

a midsole including a medial forefoot flange segment and a medial heel flange segment, and a lateral forefoot flange segment and a lateral heel flange segment, the midsole including a heel region and defining a heel recess in the heel region, the peripheral allowance being joined with at least one of the medial heel flange segment, the medial forefoot flange segment, the lateral forefoot flange segment and the lateral heel flange segment;

an outsole joined with the midsole; and wherein at least one of the medial heel flange segment, the medial forefoot flange segment, the lateral forefoot flange segment and the lateral heel flange segment include an upper surface, an outer edge and a lower surface, wherein the peripheral allowance is wrapped over the upper surface, the outer edge and the lower surface.

14. The footwear construction of claim 13 wherein stitching passes through the peripheral allowance, through the upper surface, through the lower surface, and back through the peripheral allowance.

15. A method for manufacturing footwear comprising:

providing an upper defining an interior, and including an exterior and a peripheral allowance;

joining the peripheral allowance with a midsole including a medial forefoot flange segment and a separate medial heel flange segment, and a lateral forefoot flange segment and a separate lateral heel flange segment, the midsole including a heel region and defining a heel recess in the heel region, wherein at least one of the medial forefoot flange segment, medial heel flange segment, lateral forefoot flange segment, and lateral heel flange segment include an upwardly projecting portion and an outwardly projecting portion, wherein the outwardly projecting portion is substantially completely covered by a portion of the peripheral allowance;

joining an outsole with the midsole.

16. The method of claim 15 comprising positioning a heel wedge between the outsole and the midsole in at least the heel region.

17. The method of claim 16 wherein the heel wedge defines a wedge recess, and comprising nesting the midsole heel region which defines the heel recess within at least a portion of the wedge recess.

18. The method of claim 15 wherein the outsole defines a secondary recess, and comprising nesting the midsole heel region which defines the heel recess within at least a portion of the secondary recess.

19. The method of claim 15 comprising placing a foot bed over the midsole so that at least a portion of the foot bed fits in the heel recess of the midsole.

20. The method of claim 15 wherein at least one of the heel wedge and the outsole include an upwardly extending concealment flange, comprising positioning the concealment flange in a location between at least one of the medial forefoot flange segment and the medial heel flange segment, and the lateral forefoot flange segment and the lateral heel flange segment.

* * * * *